US009655812B2

(12) United States Patent
Ton

(10) Patent No.: US 9,655,812 B2
(45) Date of Patent: May 23, 2017

(54) PEDICURE SPA APPARATUSES WITH VENTILATING SYSTEMS

(71) Applicant: Quy That Ton, Baton Rouge, LA (US)

(72) Inventor: Quy That Ton, Baton Rouge, LA (US)

( * ) Notice: Subject to any disclaimer, the term of this patent is extended or adjusted under 35 U.S.C. 154(b) by 171 days.

(21) Appl. No.: 14/214,661

(22) Filed: Mar. 14, 2014

(65) Prior Publication Data

US 2014/0259375 A1 Sep. 18, 2014

Related U.S. Application Data

(60) Provisional application No. 61/786,635, filed on Mar. 15, 2013.

(51) Int. Cl.
*A47K 3/022* (2006.01)
*A61H 35/00* (2006.01)

(52) U.S. Cl.
CPC ... *A61H 35/006* (2013.01); *A61H 2201/0149* (2013.01)

(58) Field of Classification Search
CPC ..... A61H 35/006
USPC ..... 4/621, 622, 541.1–541.6, 209 R
See application file for complete search history.

(56) References Cited

U.S. PATENT DOCUMENTS

| | | | | |
|---|---|---|---|---|
| 4,637,080 A * | 1/1987 | Hutchinson | A61H 33/60 | 137/216.2 |
| 6,363,548 B1 * | 4/2002 | Kuo | A47K 3/022 | 4/541.1 |
| 8,646,122 B2 * | 2/2014 | Ton | A61H 33/026 | 4/622 |
| 2003/0019027 A1 * | 1/2003 | Marcos | A61H 33/60 | 4/541.1 |
| 2012/0240325 A1 * | 9/2012 | Amendt | A61H 33/6005 | 4/584 |

* cited by examiner

*Primary Examiner* — Huyen Le
(74) *Attorney, Agent, or Firm* — Minh N. Nguyen

(57) ABSTRACT

A pedicure spa comprises a basin, a base, at least one inlet vent, and a ventilating system. The basin is configured to contain water for soaking feet. The base is configured to contain the basin, with the base having a front wall and a top wall. The at least one inlet vent is located in the base for receiving air, and the ventilating system is configured to circulate air. The system has pipes connecting the at least one inlet vent, with the pipes connecting to an exit pipe.

16 Claims, 4 Drawing Sheets

100

PEDICURE SPA APPARATUSES WITH VENTILATING SYSTEMS

CROSS REFERENCE TO RELATED APPLICATIONS

This application claims the benefit of U.S. provisional application entitled, "Spa Apparatuses with Ventilated Systems" having Ser. No. 61/786,635 filed on Mar. 15, 2013, all of which are entirely incorporated herein by reference.

TECHNICAL FIELD

The present disclosure is generally related to spa apparatuses and methods of use thereof and, more particularly, is related to pedicure spa apparatuses having a ventilating system.

BACKGROUND OF THE INVENTION

Many more people are getting pedicures now as it is aesthetically appealing to women and men, and healthy to the feet of everybody as it prevents ingrown toenails and other diseases of the foot. Many of the pedicures are now performed in pedicure spas that have a basin for water to soak the feet. It goes without saying that many people have smelly feet which is annoying to the pedicurist and other customers. Also, odors of the products and work done on the feet of the patrons can be spread through out the salon.

Desirable in the art is an improved pedicure spa that would improve the conventional pedicure spa.

SUMMARY

A pedicure spa comprises a basin, a base, at least one inlet vent, and a ventilating system. The basin is configured to contain water for soaking feet. The base is configured to contain the basin, with the base having a front wall and a top wall. The at least one inlet vent is located in the base for receiving air, and the ventilating system is configured to circulate air. The system has pipes connecting the at least one inlet vent, with the pipes connecting to an exit pipe.

DETAILED DESCRIPTION

Figure 1:
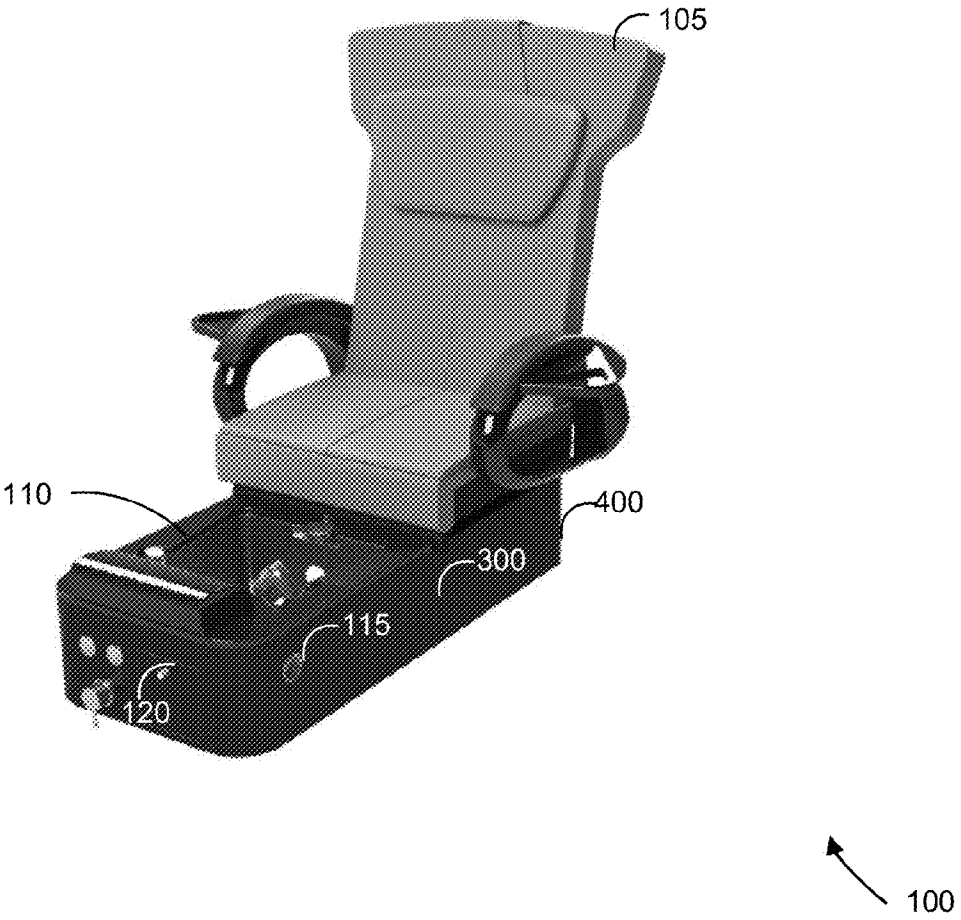
FIG. 1 is a perspective view of a pedicure spa apparatus having a ventilating system in accordance with an embodiment of the present invention.
Figure 3:
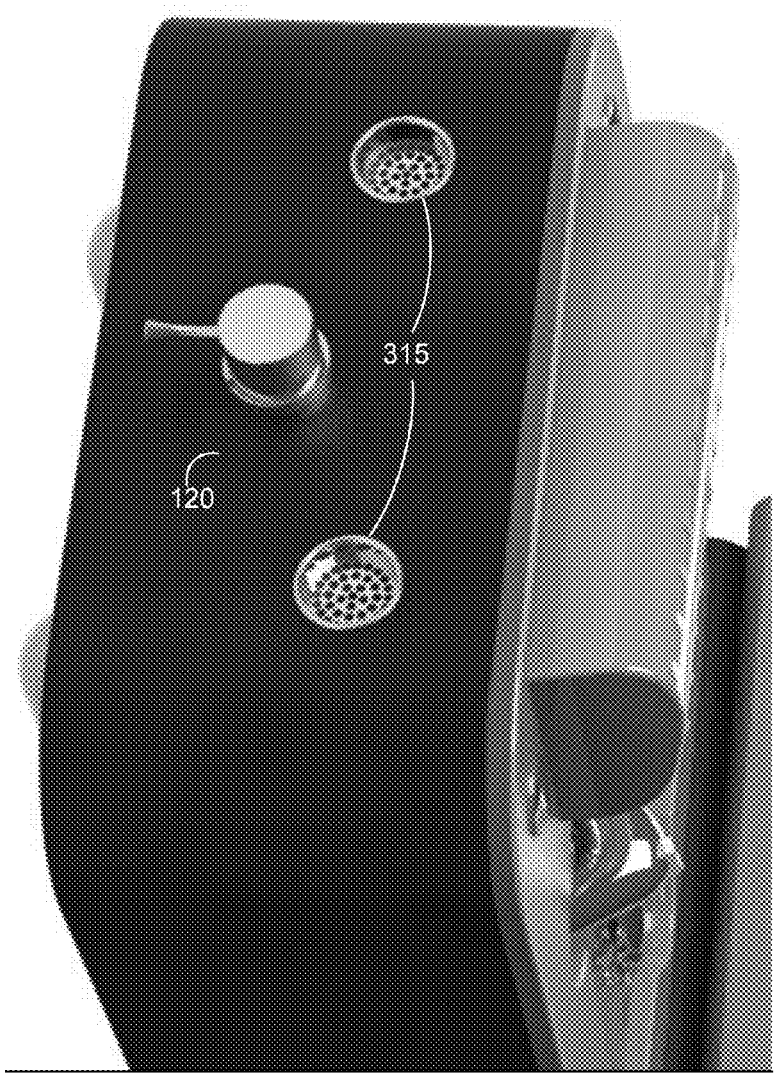
FIG. 3 is a front view of the pedicure spa apparatus having two front intake vents.
Figure 4:
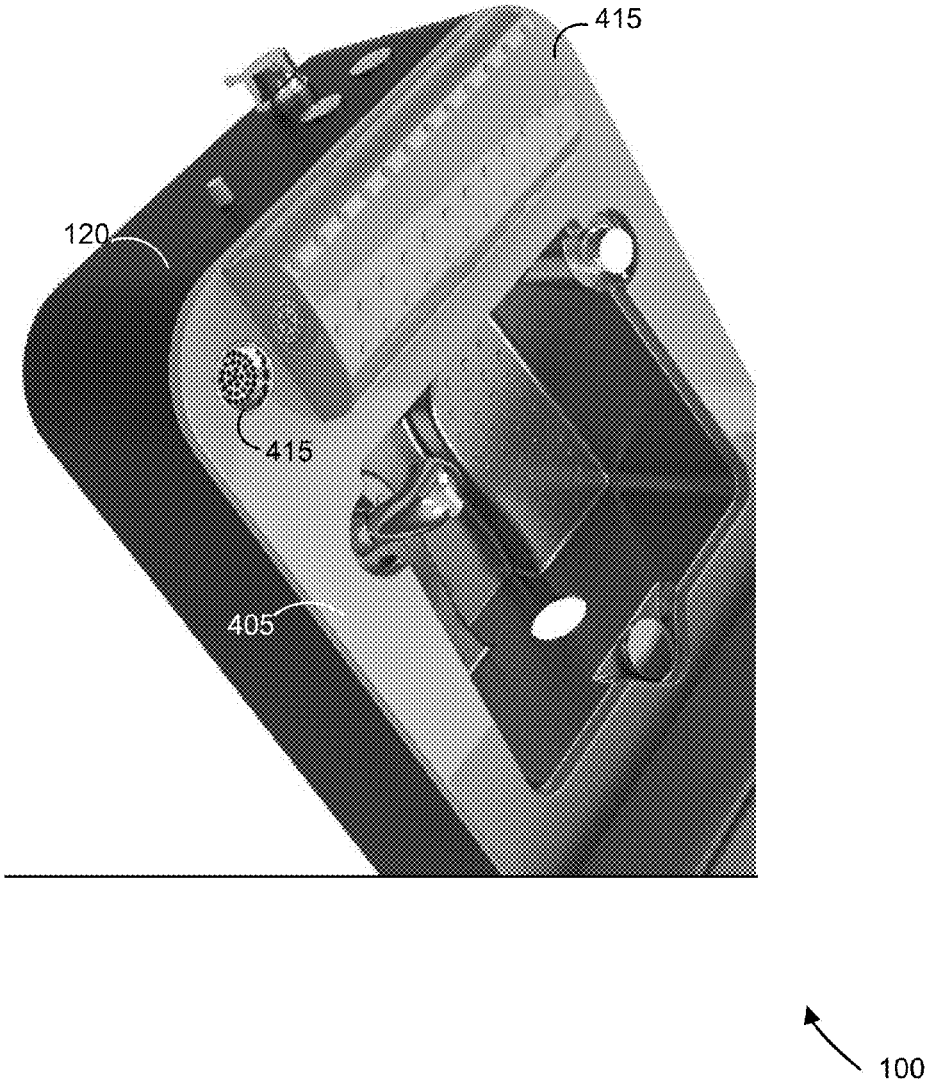
FIG. 4 is a top perspective view of the base of the pedicure spa apparatus.

FIG. 1 is a perspective view of a pedicure spa apparatus 100 having a ventilating system 201 (FIG. 2) in accordance with an embodiment of the present invention. The pedicure spa apparatus 100 includes a chair 105 that is attached to a base 110, which has a side intake vent 115. In this example, the side intake vent 115 is placed on a left side wall of the base 110. It should be noted that a side intake vent 115 can be placed on the right side wall of the base 110 in a similar location as placed on the left side wall, or an intake vent can be placed on both sides of the pedicure spa apparatus 100. Other positions of the intake vent 115 are described in connection to FIGS. 3 and 4.

Figure 2:
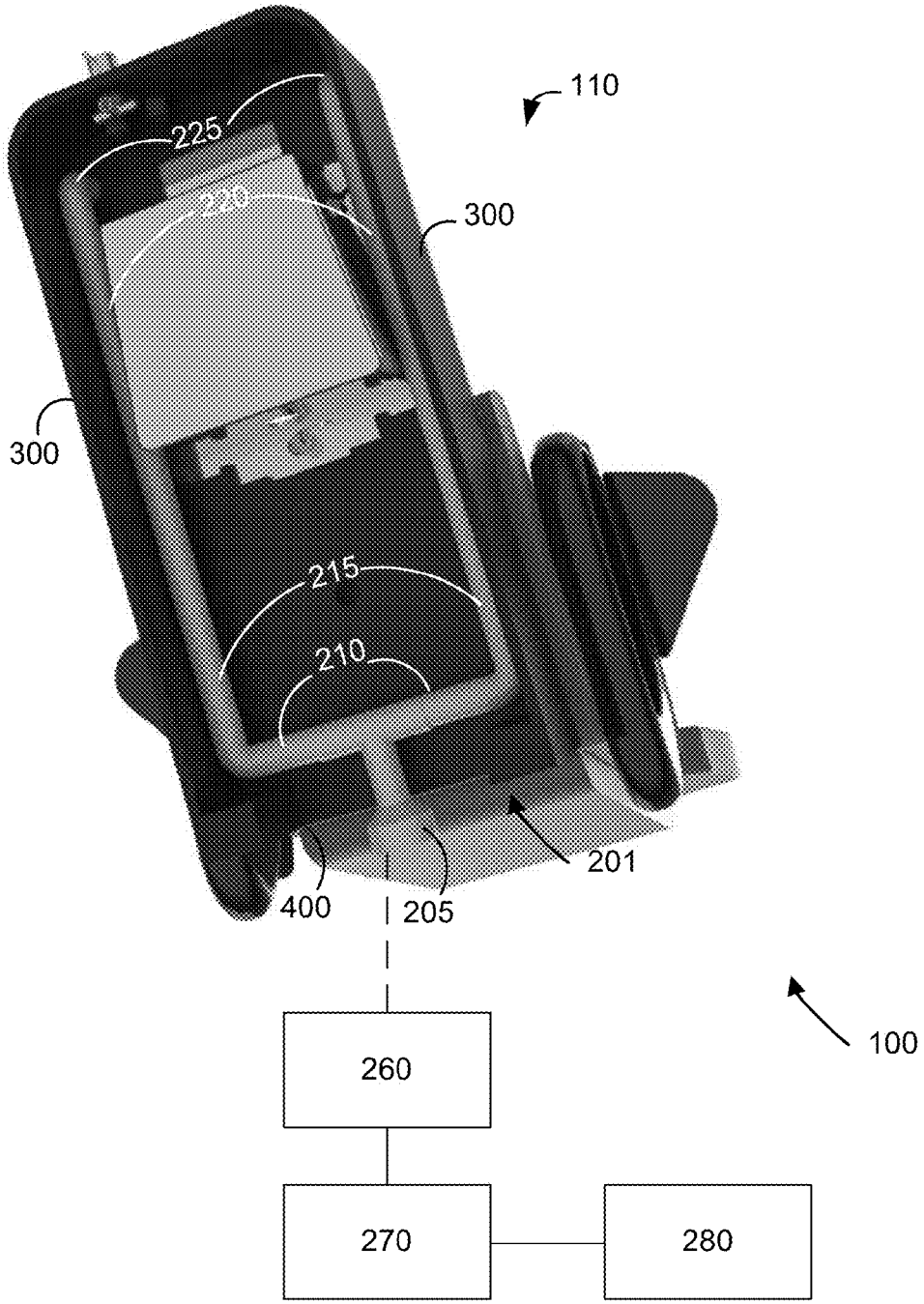
FIG. 2 is a bottom view of a pedicure spa apparatus having a ventilating system in accordance with an embodiment of the present invention.

FIG. 2 is a bottom view of a spa apparatus 100 having a ventilating system 201 in accordance with an embodiment of the present invention. In this example, the spa apparatus 100 includes a top intake vent 415 (FIG. 4) that is placed on the top wall 405 of the base 110. The ventilating system 201 includes a coupler 205 that attaches to a ventilating device (not shown, e.g., wall exhaust) that removes air from the entire intake vents 415.

The coupler 205 attaches to air channel structures 210, 215, 220, 225 that can remove air from the vents 415. The air channel structures 210 and the coupler 205 forms a "T" section that facilitates splitting the movement of the air from two directions. The ends of the "T" section are adjacent to the side walls 300 and rear wall 400. The air channel structures 215 are attached substantially perpendicular to the air channel structures 210 and positioned along the side walls 300 of the base 110. The air channel structures 215 stretches from the front wall 120 to the rear wall 400 of the base 110.

As described herein, pedicure spa apparatuses 100 having a ventilating system 201 are disclosed utilizing ventilating devices, couplers 205, air channel structures 210, 215, 220, 225, and intake vents 115, 315, 415. The ventilating system 201 facilitates moving air to and from the working area of a pedicurist near the front wall 120 of the base 110.

The air channel structures can be piping used in this ventilating system 201. The channel structure 225 can be attached to top vents 415, such as that shown in FIG. 4. Alternatively or additionally, the channel structures 220 can be attached to side intake vents 115 and front intake vents 315 on the side wall 300 and front wall 120 of the base 110, such as that shown in FIGS. 1 and 3, respectively. Alternatively or additionally, the channel structures 220 can be a perforated pipe that vents the entire bottom of the pedicure spa apparatus 100, including all of the intake vents 115, 315 and 415.

It should also be realized that this ventilating structure 201 can be used to blow air out of the intake vents 115, 315 and 415. This air could be scented or disinfected by the infusion of a scent or disinfectant into the ventilating structure by an infusion device (260).

This ventilating system 201 can be attached to a filter 270 to collect any particles from entering into an exhaust system 280 in the nail shop or a fan motor 280 can be installed in the system to exhaust the air out the rear of the system. Alternatively or additionally, the filter 270 can filter the air of any particles from exiting out of the vents 115, 315 and 415. It is preferable that the polluted air be removed through the exhaust system of the nail shop to reduce the risk of airborne diseases and obnoxious odors.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

Therefore, having thus described the disclosure, at least the following is claimed:

1. A pedicure spa comprising:

a basin for containing water for soaking feet;

a base for containing the basin with the base having a front wall, at least one side wall, a back wall, and a top wall;

at least one inlet vent in the front wall, at least one side wall, or top wall of the base for receiving air; and a ventilating system for circulating air, the system having pipes connecting the at least one inlet vent, with the pipes connecting to an exit pipe, the exit pipe connected to an outlet vent in the base, the outlet vent blowing air out of the base.

2. The pedicure spa of claim 1 in which the exit pipe is connected to an exhaust vent in the room in which the pedicure spa is located.

3. The pedicure spa of claim 1 which has a fan and power source for circulating the air from the inlet vents to the area outside the pedicure spa.

4. The pedicure spa of claim 3 in which the power source is an electric motor.

5. The pedicure spa of claim 3 in which the fan can either move the air from or to the inlet vents in the pedicure spa.

6. The pedicure spa of claim 5 in which an infusion dispenser is attached to the pipes of the ventilating system for adding scent or disinfectant to the system when the fan blowing air out of the inlet vents.

7. The pedicure spa of claim 1 in which there is at least one inlet vent in the top wall of pedicure spa and at least one inlet vent in the front wall of the spa.

8. The pedicure spa of claim 1 in which there is at least one inlet vent in the top wall of the pedicure spa.

9. The pedicure spa of claim 1 in which there is at least one inlet vent in the front wall of the pedicure spa.

10. The pedicure spa of claim 1 in which there is at least one inlet vent in a side wall of the pedicure spa.

11. The pedicure spa of claim 1 in which the ventilating system is positioned inside the base.

12. The pedicure spa of claim 1 in which there are two inlet vents in the front wall of the base.

13. The pedicure spa of claim 1 which has an inlet vent in the top wall and at least one inlet vent in the front wall.

14. The pedicure spa of claim 13 in which the inlet vent in the top wall is located near the front wall.

15. A pedicure spa comprising:

a basin for containing water for soaking feet;

a base containing the basin with the base having a front wall and a top wall, the base having an inlet vent in the top wall of the base, the front wall having at least one inlet vent;

a ventilating system for circulating air, the system having pipes in the base of the pedicure spa connected to the inlet vents, with the pipes being connected to an exit pipe; and a fan powered by an electric motor for circulating air through the inlet vents and the ventilating system with the fan being located in the base of the pedicure spa.

16. The pedicure spa of claim 15, in which there are controls for the fan so it can either blow air out of the exit pipe or out of at least one of the inlet vents.

* * * * *